US005873780A

United States Patent [19]

Mori et al.

[11] Patent Number: 5,873,780

[45] Date of Patent: Feb. 23, 1999

[54] AIR CONDITIONER

[75] Inventors: Nobuyuki Mori; Yoshimi Kawai, both of Kanagawa-ken, Japan

[73] Assignee: Fujitsu General Limited, Kawasaki, Japan

[21] Appl. No.: 857,283

[22] Filed: May 16, 1997

[30] Foreign Application Priority Data

| | | | |
|---|---|---|---|
| May 20, 1996 | [JP] | Japan | 8-124235 |
| May 20, 1996 | [JP] | Japan | 8-124259 |
| Oct. 9, 1996 | [JP] | Japan | 8-268126 |

[51] Int. Cl.[6] ..... F24F 13/075

[52] U.S. Cl. ..... 454/285; 454/315

[58] Field of Search ..... 454/153, 202, 454/285, 313, 315, 319, 321

[56] References Cited

U.S. PATENT DOCUMENTS

| | | | |
|---|---|---|---|
| 4,043,258 | 8/1977 | Zitko et al. | 454/319 |
| 5,338,251 | 8/1994 | Matsumoto | 454/285 X |

FOREIGN PATENT DOCUMENTS

| | | | |
|---|---|---|---|
| 58-129127 | 8/1983 | Japan | 454/285 |
| 62-147261 | 7/1987 | Japan | 454/313 |
| 1-212855 | 8/1989 | Japan | 454/319 |
| 2-225931 | 9/1990 | Japan | 454/285 |
| 3-274350 | 12/1991 | Japan | 454/319 |
| 5-118638 | 5/1993 | Japan | 454/153 |

*Primary Examiner*—Harold Joyce
*Attorney, Agent, or Firm*—Kanesaka & Takeuchi

[57] ABSTRACT

In an air conditioner provided with at least one longitudinal louver rotating in a vertical direction with an almost horizontal rotation axis as the center and with a number of lateral louvers rotating in a lateral direction with a rotation axis line almost perpendicular to the rotation axis line of the above-described longitudinal louver, a cover plate is provided at an upper wall portion of the above-described air outlet so that a specified space is formed between the cover plate and the upper wall portion, and each of the lateral louvers is attached at the cover plate by the medium of a bush with an arm and a connecting plate for connecting the lateral louvers formed at the bush to prevent the reduction of air blowing efficiency, generation of a noise, and condensation in an air outlet.

17 Claims, 13 Drawing Sheets

AIR CONDITIONER

BACKGROUND OF THE INVENTION

1. Field of the Invention

The present invention relates to an air conditioner, and more particularly, to the mounting structure of the louvers provided with the air outlet.

2. Description of the Related Art

In the air outlet of an air conditioner, louvers are provided in order to control the directions of the air with heat exchange being conducted to be sent evenly or, in some cases, locally to the room. FIG. 17 is a sectional view showing a general structure of an air conditioner as the conventional art, and FIG. 18 is an enlarged sectional view of the air outlet portion. An air conditioner consists of an indoor unit and an outdoor unit, and an air conditioner referred to here means an indoor unit.

Specifically, the air conditioner as the indoor unit includes a housing 1 designed to be hung on an indoor wall, and in this example, air inlet ports 2 are respectively provided on the front and top surfaces of the housing 1, with an air outlet 5 being is provided at the lower portion of the front surface of the housing 1. In the air passage from the air inlet port 2 to the air outlet 5 in the housing 1, a heat exchanger 3 and an air fan 4 are provided.

In the air outlet 5, for example, two of longitudinal louvers 7 and 8 for regulating a wind direction in a longitudinal direction, and a number of lateral louvers 6 for regulating a wind direction in a lateral direction are provided. Generally, the longitudinal louvers 7 and 8 are positioned in front of the lateral louvers when the air outlet 5 is seen from the outside (indoor side), and by the supporting piece suspended from an upper wall portion 5*a* of the air outlet 5, rotating shafts 7*a* and 8*a* are supported so as to be almost horizontal. Specifically, the vertical louvers 7 and 8 are rotatable in a longitudinal direction within a range of a specified angle with the horizontal rotating shafts 7*a* and 8*a* as the center.

Only one of the lateral louvers 6 is illustrated in FIGS. 17 and 18, but actually a number of lateral louvers 6 are provided in a direction perpendicular to the paper surface of the drawings. Conventionally, each of the lateral louvers 6 is supported in a supporting shaft hole 5*b* provided on the upper wall portion 5*a* of the air outlet 5 by the medium of the bush 9 so as to be rotated in a lateral direction with the rotational axis almost perpendicular to the rotational axis of the longitudinal louvers 7 and 8 as the center.

Specifically, each of the lateral louvers 6 has a slit 6*b* made in an axial direction and includes a supporting shaft 6*a*, radius of which can be elastically reduced by the slit 6*b*, and after the bush 9 is engaged in the supporting shaft hole 5*b* of the above-described upper wall portion 5*a*, each of the lateral louvers 6 is rotatably held at the upper wall portion 5*a* of the air outlet 5 by compulsorily engaging the supporting shaft 6*a* in the bush 9. Each of the lateral louvers 6 has a connecting-pin 6*c* for attaching a connecting plate 10 at the shoulder portion of the wing piece, and is connected to each other so as to be synchronously rotated by the medium of the connecting plate 10.

After the air fan 4 is operated, air is inhaled from the air inlet port 2, then after heat exchange is conducted at the heat exchanger 3, air is blown to a room from the air outlet 5, and at this time, a wind direction in a lateral direction is controlled by the lateral louvers 6 while a wind direction in a vertical direction is controlled by the longitudinal louvers 7 and 8.

In this way, a wind direction is variously controlled, and in the conventional art, the connecting-pin 6*c* and the connecting plate 10 are exposed in the air outlet 5, therefore at this portion air resistance occurs and there is a disadvantage of air blowing efficiency being reduced. Especially when an aircondition car is driven, condensation occurs at the connecting-pin 6*c* and the connecting plate 10, and in an extreme case, the dew drops from the air outlet 5 and makes a room dirty.

When the above-described lateral louvers 6 are rotated to and fro within a range of a specified angle by a motor, conventionally, the driving lever 13 as illustrated in FIG. 19 is connected to each of the lateral louvers 6 separately from the above-described connecting plate 10, and one end of the driving lever 13 is connected to the driving shaft of the motor which is not illustrated in the drawing by the medium of a link arm 14.

As the link arm 14, a link arm including a driving hole 14*c* engaged with the driving shaft of the motor at one end which is provided with a connecting-pin 14*a* is used, and a connecting hole 13*a* formed at one end of the driving lever 13 is engaged with the connecting-pin 14*a*. In this case, a head portion 14*b* with the radius being expanded is provided at the connecting-pin 14*a* in order that the driving lever 13 is not easily come out of the axial direction. Accordingly, a slit 13*b* is formed on the side of the connecting hole 13*a* of the driving lever 13 and the connecting hole 13*a* is engaged with the connecting-pin 14*a* by compulsorily expanding the connecting hole 13*a*.

However, according to the connecting structure, when the load, for example, on the driving lever 13 becomes heavy, there is a disadvantage that the connecting hole 13*a* is disengaged from the connecting-pin 14*a* by the medium of the slit 13*b*.

The present invention is made to solve each of the above-described conventional disadvantages, and the first object is to provide an air conditioner in which the lateral louvers can be easily assembled without exposing the connecting plate and so on connecting a number of lateral louvers.

The second object is to provide an air conditioner including a connecting means surely connecting the driving lever to the link arm on the motor side, when a number of lateral louvers are rotated to and fro by a motor by the medium of a driving lever.

SUMMARY OF THE INVENTION

In order to attain the above-described first object, the present invention is an air conditioner including a housing in which an inlet port and an air outlet are formed, with a heat exchanger and an air fan being provided in an air passage from the above-described air inlet port to the above-described air outlet, which is provided with at least one longitudinal louver rotating in a vertical direction with an almost horizontal rotation axis line as the center and a number of lateral louvers rotating in a lateral direction with a rotation axis line almost perpendicular to the rotation axis line of the above-described longitudinal louvers as the center thereof, the air conditioner includes a cover plate having a size to cover an upper wall portion of the above-described air outlet and having a number of holes provided at the position corresponding to each of the rotation supporting shafts of the above-described lateral louvers, a supporting means for supporting the cover plate with a specified interval being maintained relative to the upper wall portion of the above-described air outlet and bushes attached to the holes of the above-described cover plate so as to be free to rotate. The bush has a shaft hole in which the rotation supporting shaft of the above-described lateral louver is engaged and is provided with a base-end portion engaged in the hole of the above-described cover plate so as to be free to rotate and with an arm extending along the top surface of the above-described cover plate from the base-end portion so as to be perpendicular to the axis line of the shaft hole of the above-described lateral louvers is held at the hole of the above-described cover plate by the medium of the base-end portion of the above-described bush so as to be free to rotate with the above-described arm and the above-described connecting plate is housed in the space between the above-described cover plate and the upper wall portion of the above-described air outlet.

When the invention is explained with reference to the direction of air blown to a room, a preferable example of the above-described supporting means has the structure including a first stopping piece suspended toward the inside of the air outlet from the upstream position of the upper wall portion of the above-described air outlet and a second stopping piece suspended toward the inside of the air outlet from the down stream position of the upper wall portion of the above-described air outlet and supporting the above-described cover plate with a specified interval being maintained relative to the upper wall portion of the above-described air outlet with the first and second stopping pieces.

In this case, it is preferable that on one end of the above-described cover plate, a forked portion in a V-shaped or U-shaped form engaged with the above-described first stopping piece is formed, and that between the other end of the above-described cover plate and the above-described second stopping piece, an engaging stopping means by convexo-concave engagement is provided. Thereby the cover plate can be assembled at the air outlet by a simple operation.

At the above-described second stopping piece, a handle portion which disengages the convexo-concave engagement of the above-described engaging stopping means by elastically deforming the second stopping piece can be provided.

The other example of the structure of the above-described supporting means can include a first stopping piece provided upward from the upstream position of the upper wall portion of the above-described air outlet, and a second stopping piece suspended toward the inside of the air outlet from the down stream position of the upper wall portion of the above-described air outlet, with one end portion of the above-described cover plate being lifted up along the above-described first stopping piece so as to substantially construct a part of the above-described air outlet. At the foremost end thereof, a step portion is provided, while engaging with the end portion of said first stopping piece while providing, at the above-described second stopping piece, a holding means for the other end portion of the above-described cover plate.

When the driving lever is laid across and hooked onto each of the above-described lateral louvers and each of the above-described lateral louvers is rotated to and fro within the range of a specified angle by the driving motor by the medium of the driving lever, it is preferable that an initial angle setting means including a number of grooves for setting the initial angle of the above-described lateral louvers is formed at the above-described driving lever, and that on either one of the top and the bottom surfaces of the above-described arm, a stopping projection engaged in an arbitrary groove in the above-described initial angle setting means is provided while on the other surface of the above-described arm, a connecting means for the above-described connecting plate is provided.

In this case, a stopper for regulating the rotation range of the above-described lateral louvers which abuts at the above-described driving lever or at the above-described connecting plate can be provided at the above-described arm A first holding frame for holding the above-described driving lever can be formed on one surface of the above-described arm so that the groove of the above-described initial angle setting means is not disengaged from the above-described stopping projection.

As a connecting means for the above-described connecting plate, when using the structure defined by a connecting hole provided on the connecting plate and a connecting pin formed on the other surface of the above-described arm, it is preferable that a second holding frame for elastically holding the above-described connecting plate is provided on the other surface of the above-described arm so that the above-described connecting hole is not disengaged from the above-described connecting pin.

In another aspect of the present invention, an air conditioner includes a housing in which an inlet port and an air outlet are formed, with a heat exchanger and an air fan being provided in an air passage from the above-described air inlet port to the above-described air outlet provided with at least one longitudinal louver rotating in a vertical direction with an almost horizontal rotation axis line as the center thereof and a number of lateral louvers rotating in a lateral direction with a rotation axis line almost perpendicular to the rotation axis line of the above-described longitudinal louvers as the center thereof, and with the driving lever which is laid across and hooked onto each of the above-described lateral louvers and the above-described each of the lateral louvers is rotated to and fro within the range of a specified angle by the driving motor by the medium of said driving lever. The air conditioner includes a link arm attached between the end portion of the above-described driving lever and the above-described driving motor, a connection hole and a tongue piece partially projecting from the circumferential edge of the end portion being provided at the end portion of the above-described driving lever. A driving hole engaged with the driving shaft of the above-described driving motor is formed on one end of the above-described link arm, and a connecting-pin engaged in the connecting hole of the above-described driving lever and a housing notch which allows the tongue piece of the above-described driving lever to enter are provided on the other end of said link arm. The above-described tongue piece is located in the above-described housing notch and is placed in the above-described housing notch when the above-described link arm is rotated by the above-described driving motor within a range of a specified angle with the above-described driving hole as the center thereof. Thereby the above-described second object is attained.

In the present invention, the above-described tongue piece is projected in a direction almost perpendicular to the longitudinal direction of the above-described driving lever.

In a still another aspect of the present invention, an air conditioner includes a housing in which an inlet port and an air outlet are formed, with a heat exchanger and an air fan being provided in an air passage from the above-described air inlet port to the above-described air outlet. The air conditioner is provided with at least one vertical louver rotating in a longitudinal direction with an almost horizontal rotation axis line as the center and a number of lateral louvers rotating in a lateral direction with a rotation axis line almost perpendicular to the rotation axis line of the above-described longitudinal louver as the center, and the above-described each of the lateral louvers is rotated to and fro within the range of a specified angle by the driving motor. The air conditioner includes a cover plate having a size to cover an upper wall portion of the above-described air outlet and having a number of holes provided at the position corresponding to each of the rotation supporting shaft of the above-described lateral louvers, a supporting means supporting the cover plate with a specified interval maintained from the upper wall portion of the above-described air outlet, a bush attached in the hole of the above-described cover plate so as to be free to rotate, a first and a second driving levers assigned to each group of the lateral louvers by dividing the above-described number of the lateral louvers at almost the center thereof, and a link means connecting a connecting means connecting the end portions of said driving levers opposing to each other and one of the driving levers to the above-described driving motor the bush is provided with a base end portion having a shaft hole engaged with a rotation supporting shaft of the above-described lateral louvers and engaged in a transparent hole of the above-described cover plate so as to be free to rotate, and an arm extends along the top surface of the above-described cover plate so as to be perpendicular to the axis line of the shaft hole from the base end portion and has a connecting means for the above-described driving lever at the foremost end portion, with each of the above-described lateral louvers being held in the hole of the above-described cover plate by the medium of the base end portion of the above-described bush so as to be free to rotate, and with the above-described arm and the above-described first and second driving levers being housed in a space between the above-described cover plate and the upper wall portion of the above-described air outlet. In this way, by dividing the driving lever into two pieces, the driving lever is easily produced, transported, and the parts thereof is easily controlled.

The above-described first and second driving levers are defined by the band plates of a specified length and the above-described connecting means is defined by the combination of a concave portion formed on a flat surface of the end portion of one of the driving levers and a convex portion formed on a flat surface of the end portion of the other driving lever, and thereby the first and second driving levers can be connected by an extremely simple operation.

At the end portion including the above-described convex portion of the above-described other driving lever, a connecting piece in a U-shaped form receiving the end portion of the above-described one of the driving levers with elastic deformation is preferably formed, and thereby the connecting points of the first and second driving levers are not easily disconnected.

In order to improve the efficiency of the assembly operation at the inserting end of the above-described one of the driving levers for the open portion of the above-described connecting piece, a slanting surface is formed in order to be easily inserted into the open portion. Further, by forming a flange abutted at the open portion of the above-described connecting piece at the end portion opposite to the above-described inserting end of the above-described one of the driving levers, the connecting points of the first and second driving levers can be easily matched. It is preferable that the above-described bush has elasticity and is formed of synthetic resin containing lubricant.

The advantages by the present invention will be further understood by reading the embodiments described with reference to the attached drawings in the below.

DESCRIPTION OF THE PREFERRED EMBODIMENTS

Figure 1:
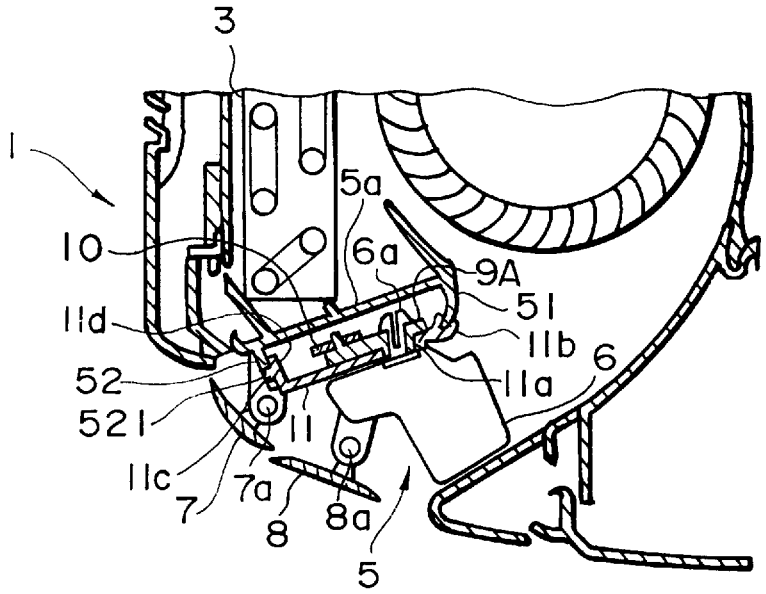
FIG. 1 is a sectional view illustrating the structure of an air outlet of a first embodiment of the present invention.
Figure 17:
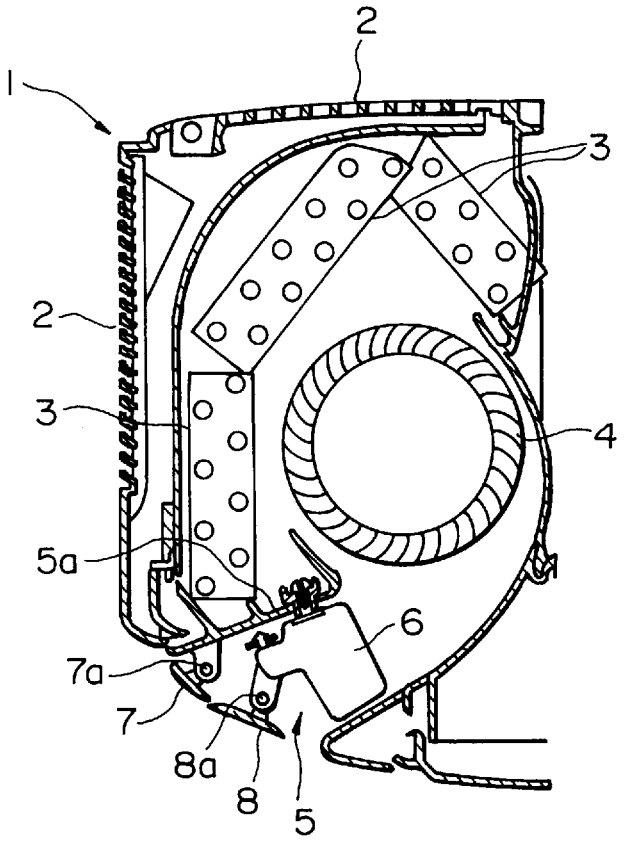
FIG. 17 PRIOR ART
FIG. 17 is a sectional view illustrating the internal structure of an air conditioner as prior art (conventional art)
Figure 18:
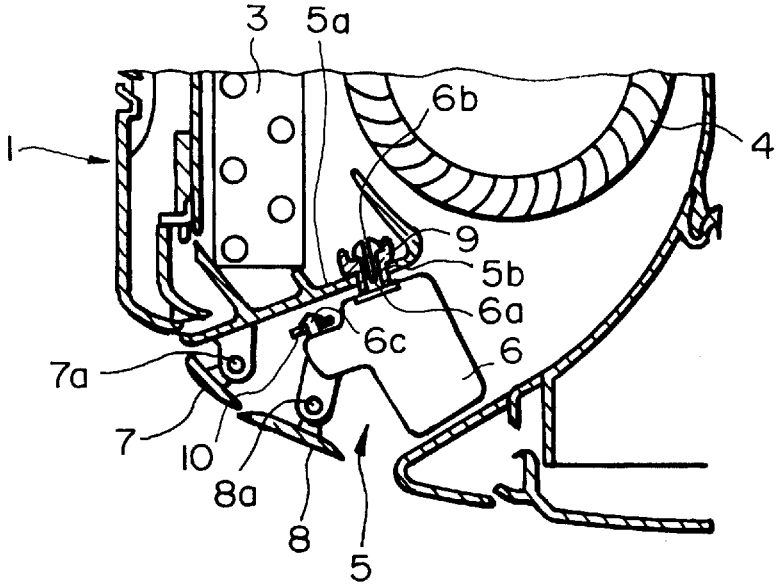
FIG. 18 PRIOR ART
FIG. 18 is a sectional view illustrating the structure of an air outlet of the above-described conventional art.
Figure 19:
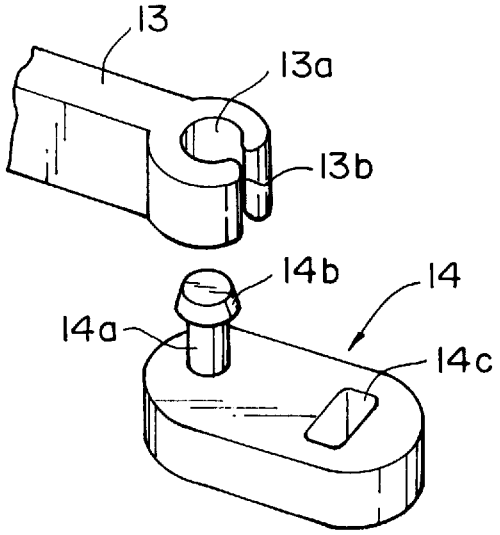
FIG. 19 PRIOR ART
FIG. 19 is a perspective view illustrating a condition in which a driving lever and a link arm used in the above-described conventional embodiment are separated.

First, the first embodiment will be explained with reference to FIGS. 1 and 2. In FIG. 1, only an air outlet 5 of the air conditioner is shown, but as for the structure of the other parts which is not illustrated in the drawing, please refer to FIG. 17 which is previously shown as the conventional art.

In the first embodiment, similarly to the conventional art previously explained, two longitudinal louvers 7 and 8, and a number of lateral louvers 6 are provided inside the air outlet 5. In this case, FIG. 1 depicts only one of the lateral louvers 6, but, actually, a number of lateral louvers 6 are provided in a direction perpendicular to the paper surface of FIG. 1. As for a structure supporting the longitudinal louvers 7 and 8, the same structure as in the conventional art is used.

When the direction in which air is blown towards the room is a reference direction, a first stopping piece 51 suspended towards the inside of the air outlet 5 is provided at the upstream position of an upper wall portion 5*a* of the air outlet 5. At the downstream position of the upper wall portion 5*a* of the air outlet 5, a second stopping piece 52 suspended towards the inside of the air outlet 5 is provided and a stopping hole 521 is provided at the second stopping piece 52.

By the first stopping piece 51 and the second stopping piece 52, a cover plate 11 is supported so that a specified space is formed between the upper wall portion 5*a* of the air outlet 5 and the cover plate 11. In the first embodiment, the cover plate 11 has, at the rear end portion thereof, a stopping portion 11*b* with a fork end having a V-shaped or U-shaped form engaging with the edge of the first stopping piece 51, and has, at the front end thereof, a flange 11*d* having a projection 11*c*.

Specifically, the cover plate 11 is held between the first stopping piece 51 and the second stopping piece 52 by a simple operation of engaging a stopping portion 11*b* at the rear end with a first stopping piece 51, lifting the flange 11*d* at the front end along the second stopping piece 52, and engaging the projection 11*c* with the stopping hole 521.

At the cover plate 11, a number of holes 11*a* are provided corresponding to each of the lateral louvers 6, and by the means of a bush 9A, each of the lateral louvers 6 is rotatably supported in the hole 11*a*.

Figure 2:
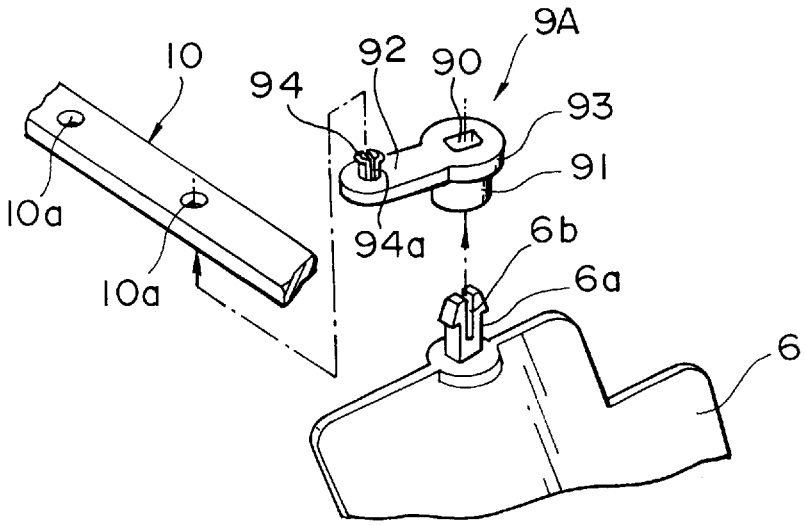
FIG. 2 is a perspective view illustrating a bush with a connecting plate and a lateral louver used in the first embodiment.

As FIG. 2 depicts, a supporting shaft 6*a* is provided at the upper edge of the lateral louver 6. The supporting shaft 6*a* has a head portion in a sagittate form and a slit 6*b* is placed from the center of the head portion along the axis line. The radius of the supporting shaft 6*a* can be elastically reduced because of the slit 6*b*.

The bush 9A includes a base end portion 91 having a shaft hole 90 with which the above-described supporting shaft 6*a* is engaged, and an arm 92 provided at the upper edge of the base end portion 91so as to be perpendicular to the axis line of the shaft hole 90. The base end portion 91 is in a cylindrical form rotatably engaged in the hole 11*a* of the cover plate 11, and a flange 93 having a radius larger than the hole 11*a* is formed at the upper edge thereof. At the shaft hole 90 and the supporting shaft 6*a*, flat portions are formed in order to transmit the rotation of the bush 9A to the lateral louver 6.

An arm 92 is extensively provided at the flange 93, and at the foremost end thereof, a connecting-pin 94 for attaching a connecting plate 10 is provided. On the connecting plate 10, a number of connecting holes 10*a* are provided at a specified interval maintained, specifically, at almost the same interval as that existing between lateral louvers 6. The connecting-pin 94 is a cylindrical pin having a head portion with a radius larger than the connecting hole 10*a*, and a slit 94*a* is placed from the center of the head portion along the axis line. By this slit 94*a*, the radius of the connecting-pin 94 can be elastically reduced.

On assembling, the base end portion 91 of the bush 9A is initially inserted into each hole 11*a* of the cover plate 11 from above. Then the supporting shaft 6*a* of each of the lateral louvers 6 is compulsorily engaged in the shaft hole 90 of the bush 9A from the lower part of the cover plate 11 while reducing the radius of the supporting shaft 6*a*, and the head portion thereof is upwardly projected from the shaft hole 90. As a result, each of the lateral louvers 6 is held at the cover plate 11 by the bush 9A without falling off. Thereafter, the connection plate 10 is attached to the bush 9A by compulsorily engaging the connecting hole 10*a* of the connecting plate 10 with the connecting-pin 94 of the arm 92. Incidentally, the lateral louver 6 can be attached to the bush 9A after the connecting plate 10 is attached to the bush 9A.

In this way, a number of lateral louvers 6 are attached to the cover plate 11. Then, the cover plate 11 is attached between the first stopping piece 51 and the second stopping piece 52 according to the steps described in the above.

According to the above, the cover plate 11 substantially forms the upper wall portion of the air outlet 5, and covers the connecting plate 10, the connecting-pin 94 and so on. Therefore air blowing efficiency is not reduced, noise is not produced, or condensation does not occur, which is the disadvantage of the conventional art.

Figure 3:
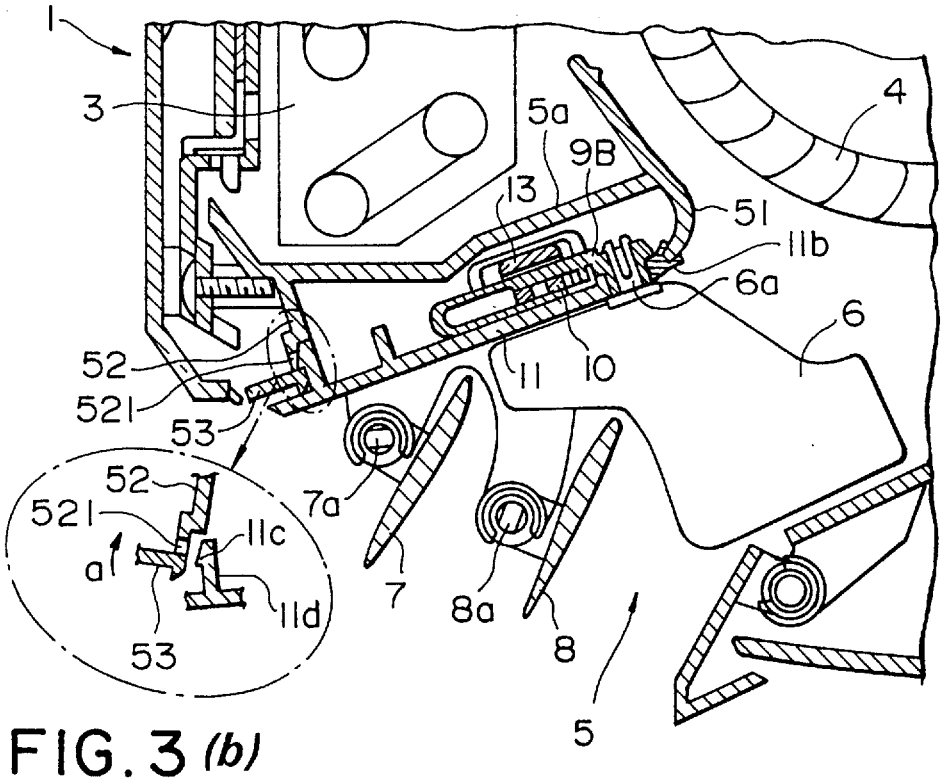
FIG. 3*a* is a sectional view illustrating the structure of the air outlet of a second embodiment of the present invention, and FIG. 3(*b*) is a part shown in FIG. 3(*a*)

Next, the second embodiment illustrated in FIG. 3(*a*) through FIG. 10 will be explained. As for the cover plate 11, a point different from the above-described first embodiment is that a handle 53 is integrally formed at the bottom end of the second stopping piece 52. The handle 53 extends toward the front of the air outlet 5 (forwards) so as to be easily operated by fingers, and by lifting up handle 53 in a direction of an arrow as illustrated in the diagram in FIG. 3(*b*), that is, in an upper direction, the engagement of the stopping hole 521 and the projection 11*c* can be easily separated. Accordingly, it is convenient to perform maintenance.

Figure 4:
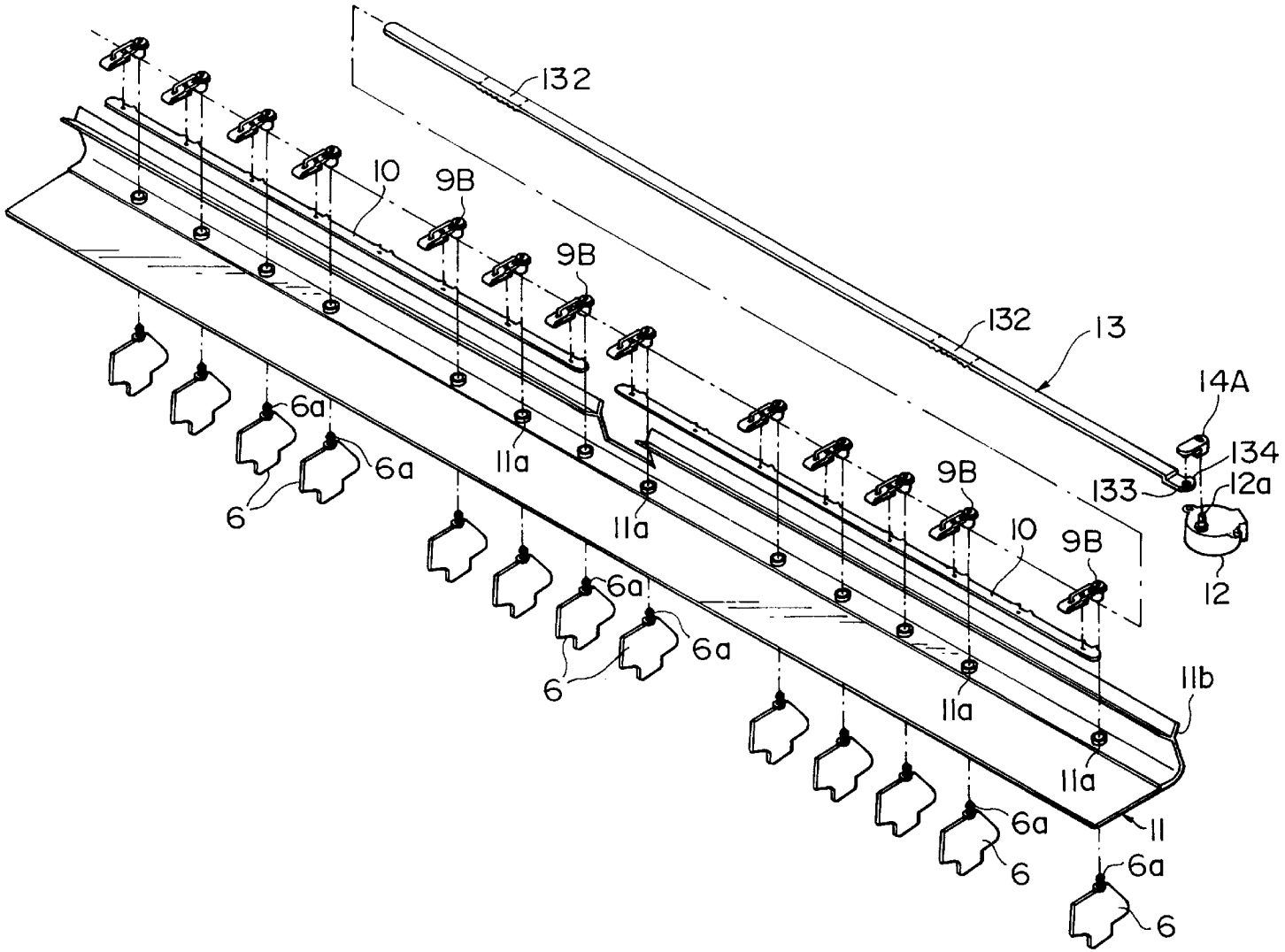
FIG. 4 is a fragmentary exploded perspective view of the second embodiment.

In the second embodiment, each of the lateral louvers 6 is connected to each other so as to be synchronously rotated by the connection plate 10, but as FIG. 4 depicts, in addition to the above, a structure is adopted in which each of the lateral louvers 6 is rotated to and fro within the range of a specified angle by a motor 12 as a driving means by the medium of a driving rod 13.

Figure 5:
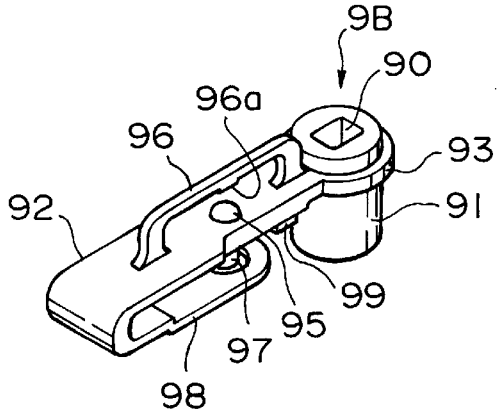
FIG. 5 is a perspective view illustrating a bush used in the second embodiment.
Figure 6:
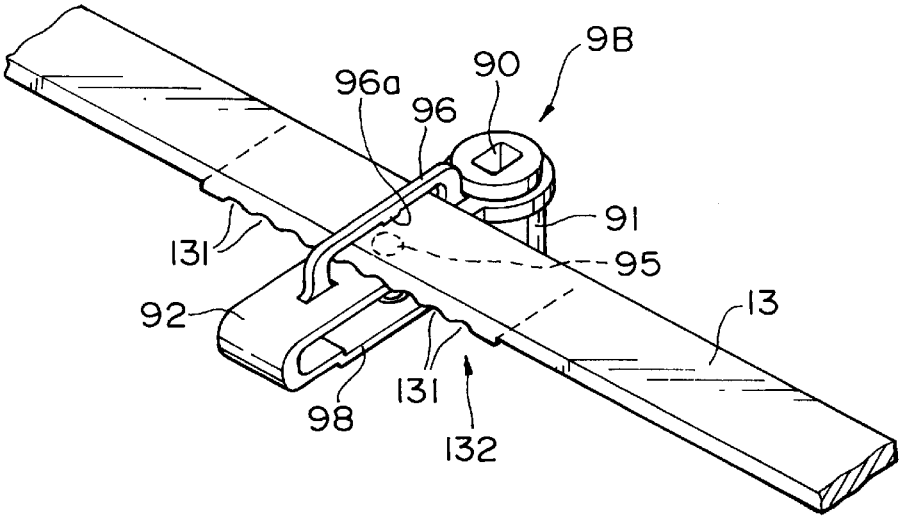
FIG. 6 is a fragmentary perspective view illustrating a condition in which a driving lever is attached to the bush used in the second embodiment.

For this reason, as FIG. 5 depicts, a projection 95 in a hemispherical form is provided on the top surface of the arm 92 of a bush 9B as an engaging means for the driving lever 13. On the other hand, as FIG. 6 depicts, an initial angle setting means 132 successively provided with a number of grooves 131 in a wave-shaped form is formed on the bottom surface of the driving lever 13. Specifically, the initial angle of the lateral louver 6 can be set by engaging the projection 95 in either one of the grooves 131 in the initial angle setting means 132.

In order to engage the projection 95 in the groove 131 with proper friction, a holding frame 96 in a gate form, into which the driving lever 13 is inserted, is formed on the top surface of the arm 92, and at the holding frame 96, a projection 96*a* is provided for urging the driving lever 13 to the projection 95 side.

On the bottom surface of the arm 92 of the bush 9B, a connecting-pin 97 engaging in the connecting hole 10*a* of the connecting plate 10 is projectingly provided. On the bottom surface of the arm 92, a holding piece 98 for maintaining the engagement of the connecting-pin 97 in the connecting hole 10*a* is provided. In the embodiment, the holding piece 98 is folded back over almost 180 degrees from the foremost end of the arm 92, and the interval between the holding piece 98 and the bottom surface of the arm 92 is almost equal to the thickness of the connecting plate 10.

Figure 7:
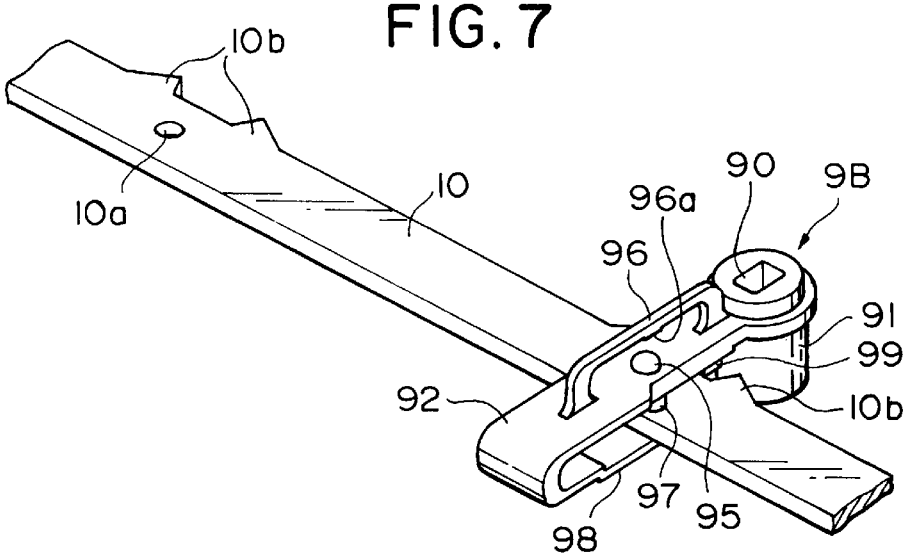
FIG. 7 is a fragmentary perspective view illustrating a condition in which a connecting plate is attached to the bush used in the second embodiment.

According to the second embodiment, a stopper 99 for regulating the rotation range of the lateral louver 6 is projectingly provided downwards near the base end portion 91 of the bottom surface of the arm 92. On the other hand, as FIG. 7 depicts, a pair of regulating pieces 10*b* and 10*b* abutting on the stopper 99 when the connecting plate 10 is moved for a specified amount are provided at the connecting plate 10. Specifically, the moving amount of the connecting plate 10, for example in a right direction, is regulated by one regulating piece 10*b*, and the moving amount in a left direction is regulated by the other regulating piece 10*b*.

The driving lever 13 is connected to the bush 9B (refer to FIG. 6) by being inserted through the holding frame 96 in a gate form provided on the top surface of the arm 92, and the connecting plate 10 is connected to the bush 9B (refer to FIG. 7) by engaging the connecting hole 10*a* with the connecting pin 97 with the holding piece 98 being pressed and expanded.

In the second embodiment, as FIG. 4 depicts, a number of lateral louvers 6 are divided into two groups at almost the center thereof, and the connecting plate 10 is assigned to each group. On the other hand, only one driving lever 13 is used, and the initial angle setting means 13*a* is provided at the position corresponding to either one of lateral louvers 6 in each group.

Specifically, the lateral louvers 6 in each group is connected by the connecting plate 10, and if the driving force rotating the lateral louver 6 is given to either one of lateral louvers 6 in the group by the driving lever 13, the driving force is transmitted to the other lateral louvers 6 by the medium of the connecting plate 10.

Since the driving lever 13, the connecting plate 10, and so on can be attached on the bush 9B as described in the above, in order to reduce the friction resistance, it is preferable that the bush 9B including each portion such as the base end portion 91, the arm 92, and so on has elasticity and is integrally formed from synthetic resin such as polyacetal containing a wax component as lubricant.

Figure 8:
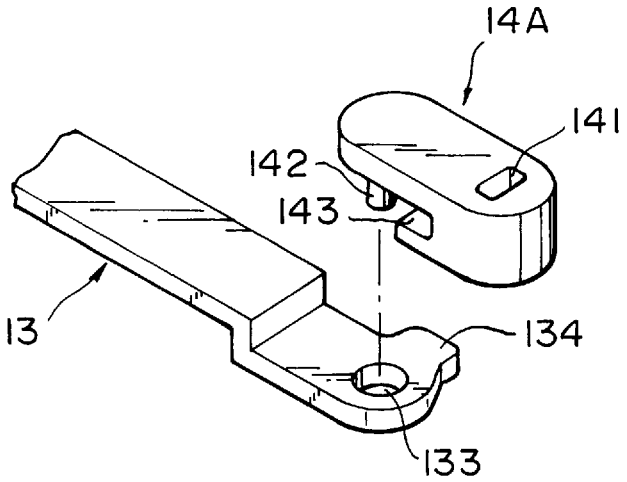
FIG. 8 is a perspective view illustrating a condition in which the driving lever and a link arm are separated in the second embodiment.

In the second embodiment, the driving lever 13 is connected to the motor 12 by the medium of a link arm 14A illustrated in FIG. 8. Explaining the connecting structure, the connecting hole 133 is provided at one end of the driving lever 13, and at the end portion, a tongue piece 134 partially projected is provided. In this case, the direction in which the tongue piece 134 extends is a direction almost perpendicular to the longitudinal direction of the driving lever 13.

At one end of the link arm 14A, formed is a driving hole 141 for engaging with the driving shaft 12*a* (refer to FIG. 4) of the driving motor 12. At the other end of the link arm 14A, a connecting-pin 142 engaging in a connecting hole 133 of the driving lever 13, and a housing notch 143 allowing the tongue 134 of the driving lever 13 to enter are provided.

Figure 9A:
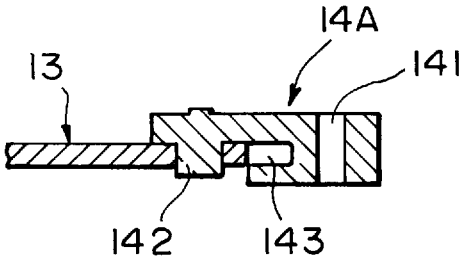
FIG. 9A is a sectional view of a condition in which the link arm is attached to the above-describe driving lever.
Figure 9B:
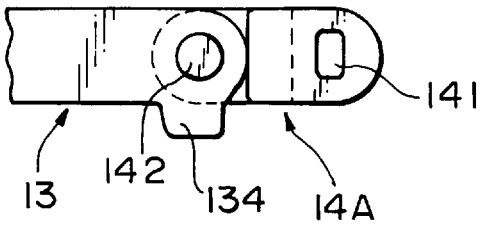
FIG. 9B is a bottom view with the link arm being attached to the above-described driving lever.

As FIGS. 9A and 9B depict, with the longitudinal directions of the driving lever 13 and the link arm 14A being matched, the connecting pin 142 is engaged in the connecting hole 133, and when the driving lever 13 and the link arm 14A are relatively rotated over a specified angle with the engaging portion as its center, the tongue piece 134 enters the housing notch 143. Accordingly, within the range of a specified angle where the tongue piece 134 enters the housing notch 143, the connecting pin 142 and the connecting hole 133 do not disengage in the axial direction.

Figure 10A:
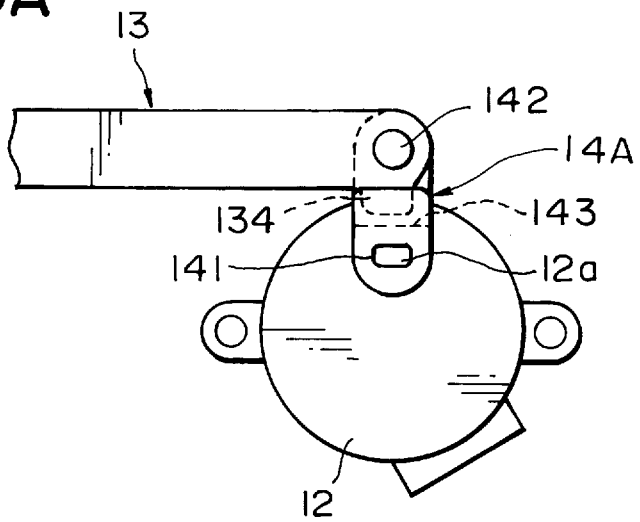
FIG. 10A through FIG. 10C are operational explanatory diagrams of the above-described driving lever and the link arm.

More specifically, after the driving lever 13 and the link arm 14A are connected with the longitudinal directions thereof being matched as described in the above, the link arm 14A is attached to the driving shaft 12*a* of the driving motor 12, as FIG. 10A depicts, with the link arm 14A being rotated over 90 degrees to the tongue piece 134 relative to the driving lever 13.

Figure 10B:
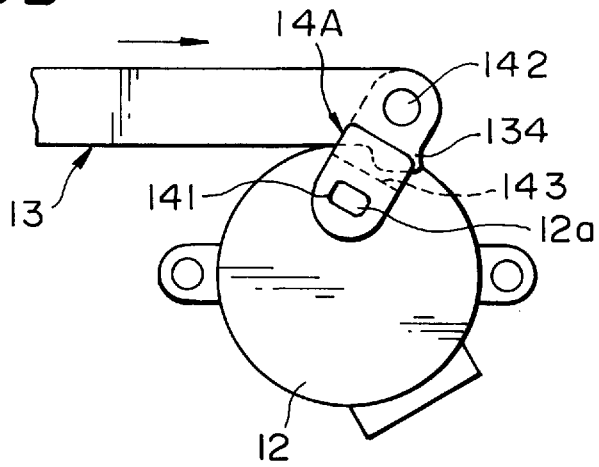
Figure 10C:
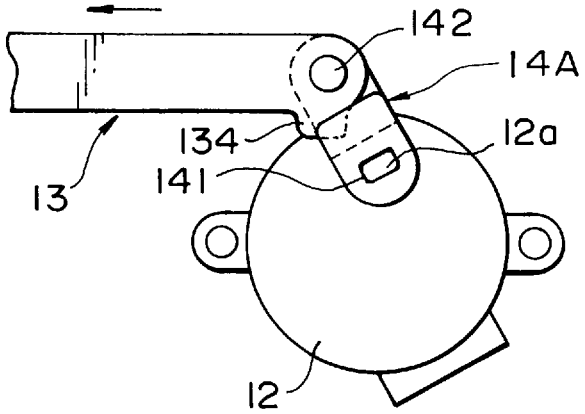

When this condition is a neutral position, the link arm 14A is driven to and fro between the right limit position illustrated in FIG. 10B and the left limit position illustrated in FIG. 10C by the motor 12, and by designing the amount of the opened angle of the tongue piece 134 so that the tongue piece 134 do not come out of the housing notch 143 in the rotating range, the driving lever 13 can be surely prevented from falling out of the link arm 14A.

Next, the third embodiment will be explained. In the third embodiment, as FIG. 11 depicts, on supporting the cover plate 11, a first stopping piece 51*a* is provided upwards at the upstream position of the upper wall portion 5*a* of the air outlet 5, then correspondingly, one end portion 111 of the cover plate 11 is lifted up along the first stopping piece 51*a* so as to substantially construct a part of the air outlet 5, and a stopping step portion 112 in a convex form engaging with the end portion of the first stopping piece 51*a* is provided at the foremost end portion thereof.

At the downstream position of the upper wall portion 5*a* of the air outlet 5, the second stopping piece 52 having the stopping hole 521 is suspended as in each of the above-described embodiments, and in this third embodiment, at the other end portion 113 of the cover plate 11 corresponding to the second stopping piece 52, a female screw hole 114 is formed, and by screwing a male screw 115 into the female screw hole 114 from the stopping hole 521 of the second stopping piece 52, the other end portion 113 of the cover plate 11 is screwed to the second stopping piece 52.

In the third embodiment, the cover plate 11 can be also attached so that a space is formed between the upper wall portion 5*a* of the air outlet 5 and the cover plate 11 by engaging the stopping step portion 112 at one end portion 111 of the cover plate 11 with the end portion of the first stopping piece 51*a* and by screwing the other end portion 113 of the cover plate 11 to the second stopping piece 52.

Figure 11:
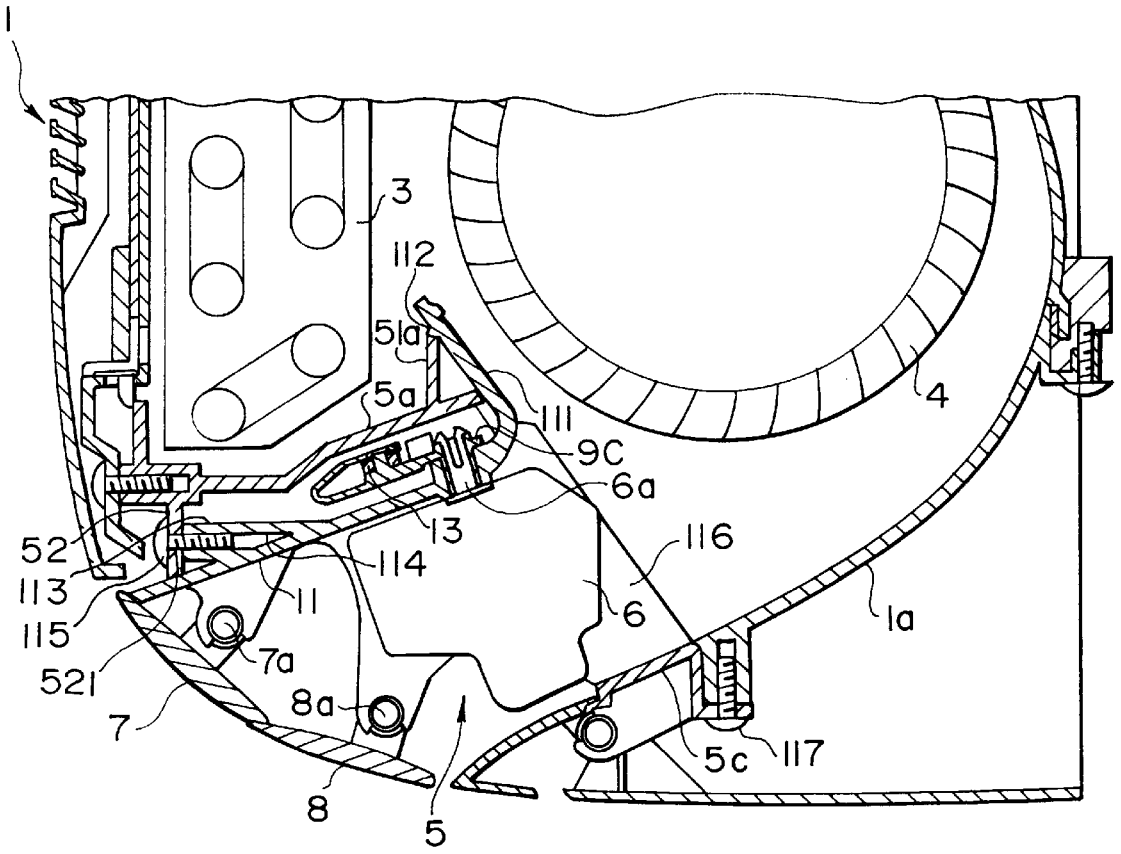
FIG. 11 is a sectional view illustrating the structure of the air outlet of a third embodiment of the present invention.

According to the third embodiment, as FIG. 11 depicts, a lower wall portion 5*c* of the air outlet 5 is formed integrally with the cover plate 11 by the medium of a supporting plate 116. FIG. 11 depicts only one of the supporting plates 116, but actually, a number of supporting plates 116 are provided in a width direction of the air outlet 5 perpendicular to the surface of the paper of the drawing with a specified interval between the supporting plates 16. Accordingly, the lower wall portion 5*c* of the air outlet 5 as well as the cover plate 11 is attachable to and detachable from the air outlet 5, and when attached to the air outlet 5, the rear end portion of the lower wall portion 5*c* is fixed to a frame member 1*a* within the housing 1 by a screw 117.

Figure 12:
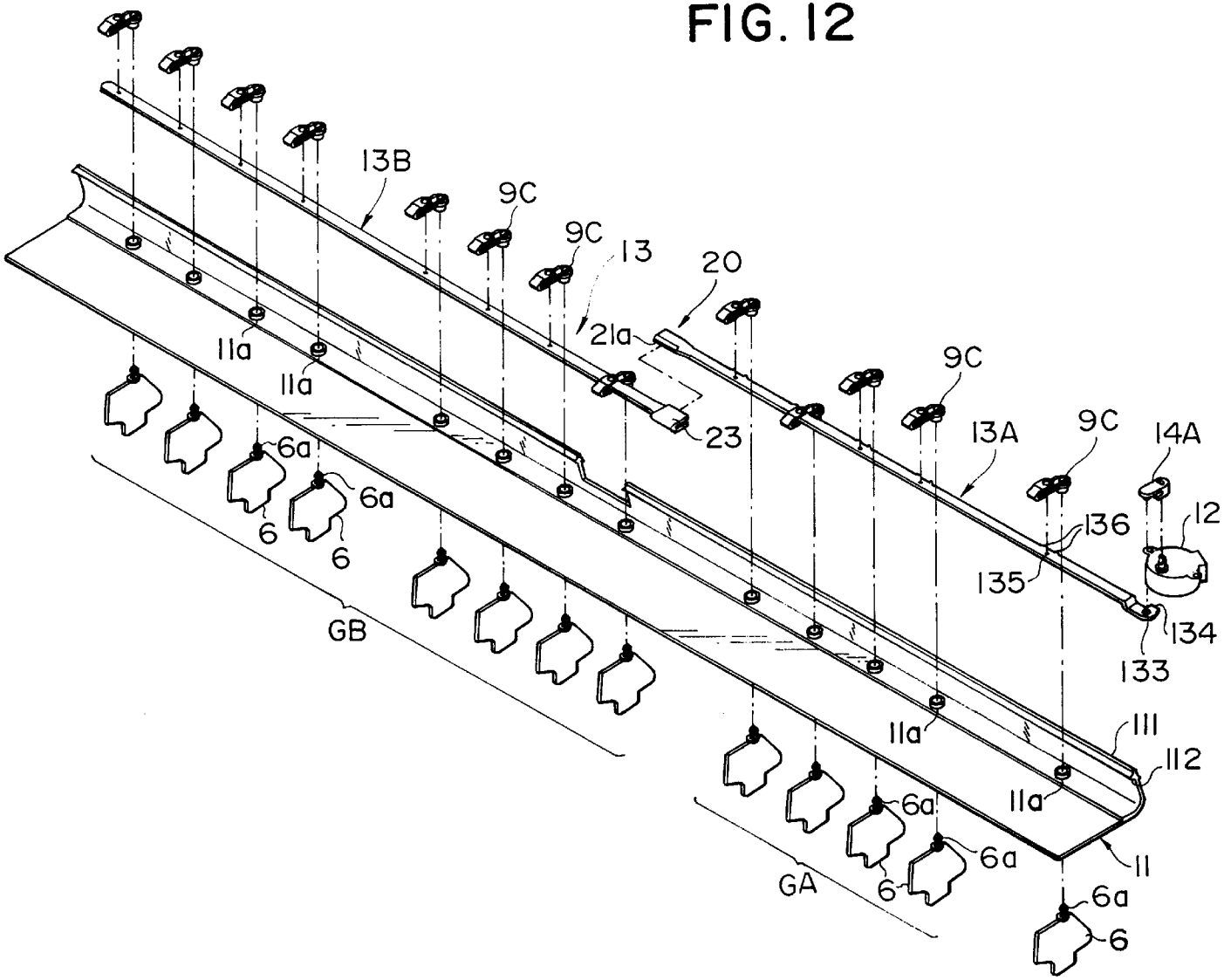
FIG. 12 is a fragmentary exploded perspective view of the third embodiment.

In the above-described second embodiment, each of the lateral louvers 6 is connected by the connecting plate 10, and is moved to and fro in a lateral direction by the motor 12 by the medium of the driving lever 13, but in the third embodiment, each of the lateral louvers 6 is only driven by the driving lever 13 as illustrated in FIG. 12, without using the connecting plate 10.

A number of lateral louvers 6 are attached to the cover plate 11 in a single line by the medium of a bush 9C along the entire width of the air outlet 5 as in the above-described embodiment, and in the third embodiment, a number of lateral louvers 6 are divided into two groups GA and GB at the almost central position while the driving lever 13 is divided into a first driving lever 13A and a second driving lever 13B of almost the same length, and the first driving lever 13A is assigned to one group GA, with the second driving lever 13B being assigned to the other group GB.

In this way, by dividing the driving lever 13 into the first and second driving levers 13A and 13B, it is not necessary to produce the driving lever 13 with the length corresponding to the entire width of the air outlet 5, therefore smaller and less expensive molding metal molds can be used when the driving lever 13 is made of synthetic resin and there exists an advantage of being easily handled in transportation and storage. In the explanation below, when it is not necessary to separately explain the first driving lever 13A and the second driving lever 13B, they are simply referred to as the driving lever 13.

Figure 13:
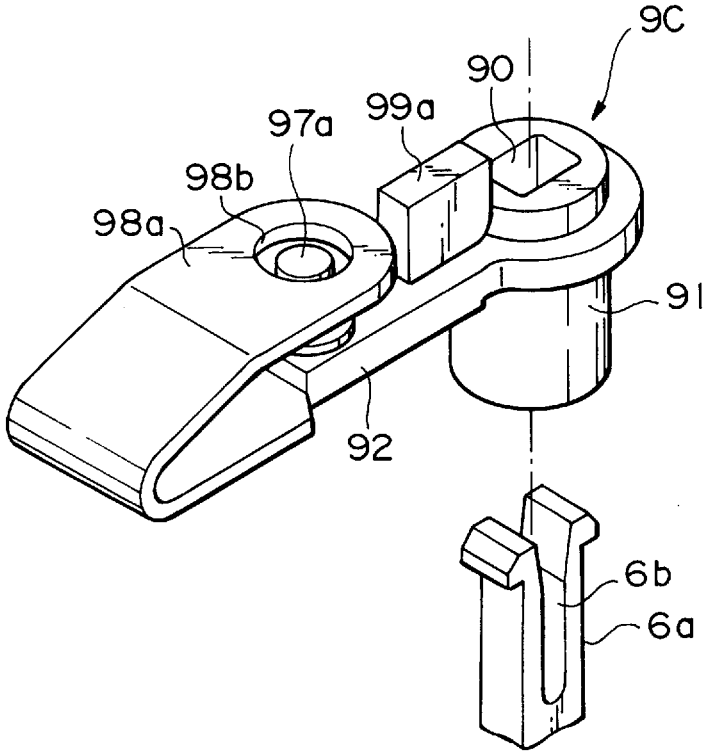
FIG. 13 is a perspective view illustrating a bush used in the third embodiment.

FIG. 13 depicts the bush 9C used in the third embodiment. Specifically, the bush 9C includes the base end portion 91 rotatably engaged in the transparent hole 11*a* of the cover plate 11, and the arm 92 provided at the upper edge of the base end portion 91. At the base end portion 91, the shaft hole 90, in which the supporting shaft 6*a* of the lateral louver 6 is engaged, is provided. The supporting shaft 6*a* of the lateral louver 6 has a head portion in a sagittate form and the slit 6*b* is placed along the shaft line from the center of the head portion. By the slit 6*b*, the radius of the supporting shaft 6*a* can be elastically reduced.

The arm 92 is extended from the upper edge of the base end portion 91 in a direction perpendicular to the shaft hole 90, and on the top surface thereof the connecting-pin 97*a* for connecting the driving lever 13 is provided. A flange 98*a* folded back so as to cover the upper portion of the connecting-pin 97*a* is provided at the foremost end of the arm 92. At the flange 98*a*, a hole 98*b* with a radius larger than that of the connecting-pin 97*a* is provided, and in a normal condition, the head portion of the connecting-pin 97*a* enters the hole 98*b*. On the top surface of the arm 92, a stopper 99*a* for regulating the rotating range of the lateral louver 6 is projectingly provided.

Figure 14:
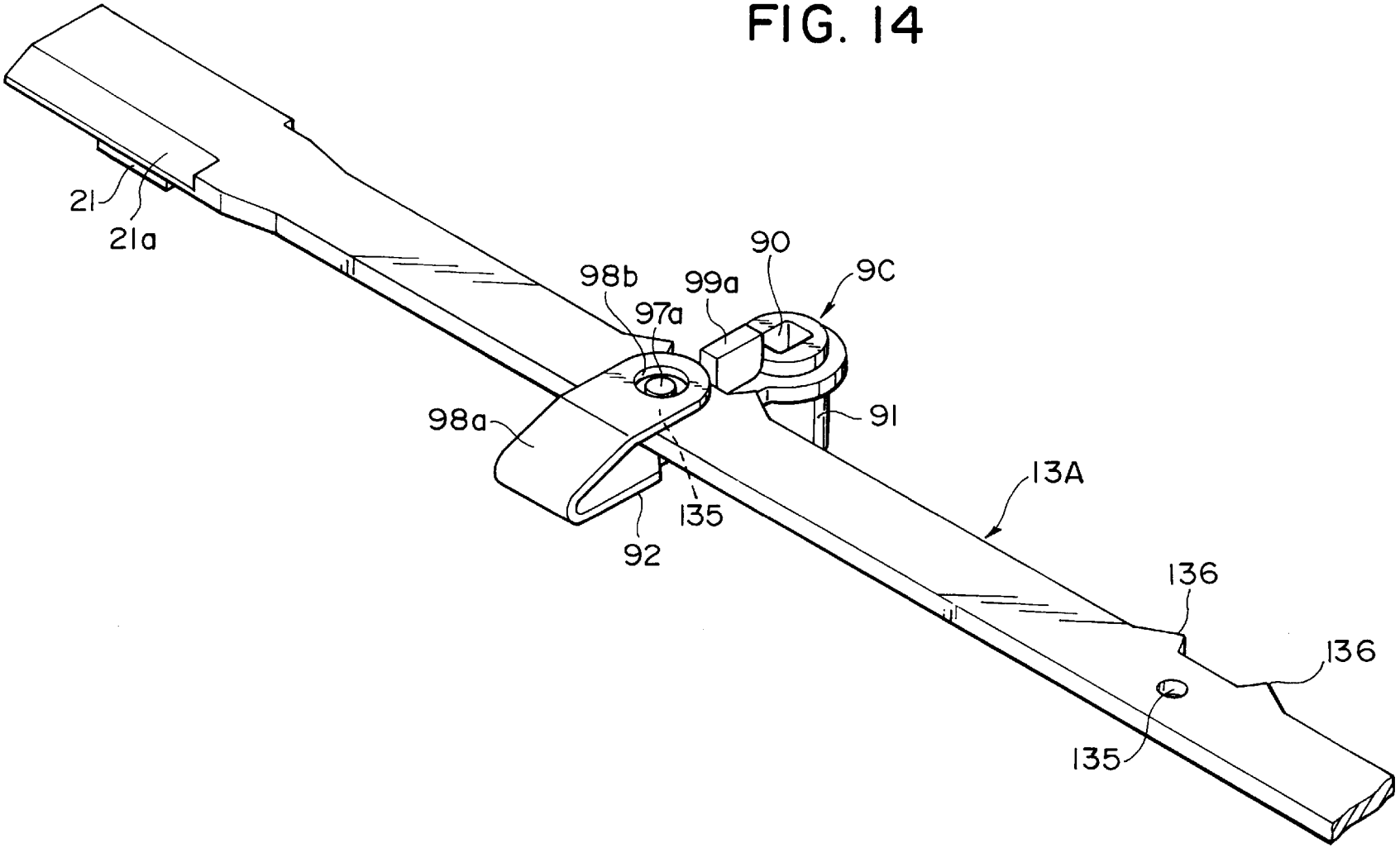
FIG. 14 is a fragmentary perspective view illustrating a condition in which the driving lever is attached to a bush of the third embodiment.

As FIG. 14 depicts, on the driving lever 13, a connecting hole 135 engaged with the above-described connecting-pin 97*a* is provided, and a pair of regulating pieces 136 and 136 which are abutted to the above-described stopper 99*a* when the driving lever 13 is moved for a specified amount is provided.

The bush 9C preferably has elasticity and is integrally molded from synthetic resin such as polyacetal resin containing wax component as lubricant, and by lifting up the flange 98*a* and engaging the connecting pin 97*a* in the connecting hole 135 of the driving lever 13, the driving lever 13 is connected to each bush 9C without falling off.

Figure 15:
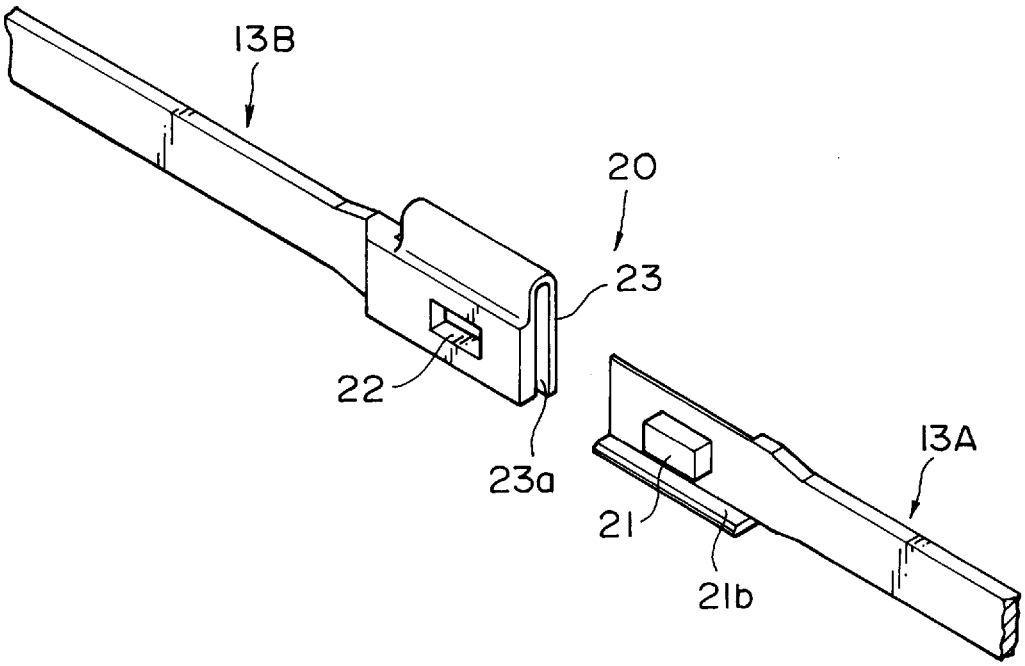
FIG. 15 is a perspective view illustrating a connecting means connecting the first driving lever and the second driving lever of the third embodiment.
Figure 16:
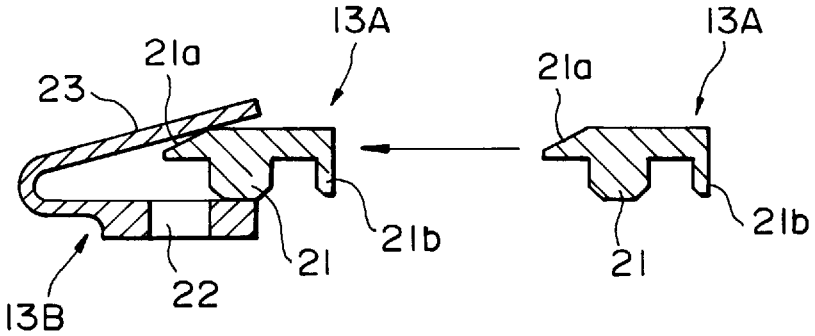
FIG. 16 is an operational explanatory view of the above-described connecting means.

Of the first and second driving levers 13A and 13B, in the embodiment, the first driving lever 13A is operatively connected to the motor 12 by the medium of the link arm 14 explained in the above-described second embodiment, and the first driving lever 13A and the second driving lever 13B are connected by a connecting means 20 illustrated in FIGS. 15 and 16. FIG. 15 is a perspective view of the connecting means 20 seen from the bottom side of the driving lever 13.

Specifically the connecting means 20 includes a connecting projection 21 in a rectangular form formed at the first driving lever 13A and a connecting hole 22 formed at the second driving lever 13B. In this case, the connecting projection 21 and connecting hole 22 are provided on the bottom surface of the driving levers 13A and 13B, and a holding piece 23 with one side edge being folded towards the other side edge and with the other side edge portion forming an open portion 23*a* is provided at the second driving lever 13B.

As FIG. 16 depicts, the first driving lever 13A is integrally connected to the second driving lever 13B by compulsorily pressing the end portion into the holding piece 23 while elastically deforming the holding piece 23 from the direction perpendicular to the longitudinal direction of the lever 13A, and by engaging the connecting projection 21 in the connection hole 22.

In this case, on one side surface of the first driving lever 13A, a taper 21*a* is formed so as to be easily inserted into the holding piece 23. On the other side surface of the first driving lever 13A, the flange 21*b* abutted to the open end of the holding piece 23 is formed, and by the flange 21*b*, the first and second driving lever 13A and 13B can be more accurately connected with straightness being held.

In the third embodiment, the bush 9C and the driving lever 13 are housed in the space between the upper wall portion 5*a* of the air outlet 5 and the cover plate 11, therefore the air blowing efficiency is not reduced, or a noise is not produced, or condensation does not occur.

According to the third embodiment, the lateral louvers 6 and the driving lever 13 can be assembled on the cover plate 11, therefore the assembling operability can be dramatically improved.

Further, by dividing the driving lever into two pieces, when the driving lever is made of synthetic resin, small and less expensive metal mold can be used, so that there is an advantage of being easily handled in transportation and storage.

We claim:

1. An air conditioner including a housing in which an inlet port and an air outlet are formed, with a heat exchanger and an air fan being provided in an air passage from the air inlet port to the air outlet provided with at least one longitudinal louver rotating in a vertical direction with an almost horizontal rotation axis line and a number of lateral louvers connected by a connecting plate and rotating in a lateral direction with a rotation axis line almost perpendicular to the rotation axis line of the longitudinal louver, comprising:

a cover plate having a size to cover an upper wall portion of the air outlet and having a number of holes provided at positions corresponding to each of rotation supporting shafts of the lateral louvers;

supporting means for supporting said cover plate with a specified interval being maintained from the upper wall portion of the air outlet; and bushes attached to the holes of the cover plate so as to be free to rotate, said bush being provided with a base-end portion which has a shaft hole engaged with the rotation supporting shaft of the lateral louver and which is engaged in the hole of the cover plate so as to be free to rotate and being provided with an arm extending along a top surface of the cover plate from said base-end portion so as to be perpendicular to an axis line of the shaft hole, and each of the lateral louvers being held at the hole of the cover plate by the base end portion of the bush so as to be free to rotate, with the arm and the connecting plate being housed in a space between the cover plate and the upper wall portion of the air outlet.

2. The air conditioner according to claim 1, wherein the supporting means includes a first stopping piece suspended toward an inside of the air outlet from an upstream position of the upper wall portion of the air outlet, and a second stopping piece suspended toward the inside of the air outlet from a down stream position of the upper wall portion of the air outlet, with a direction of air blown toward a room from the air outlet being a reference, said first and second stopping pieces supporting the cover plate with a specified interval being maintained relative to the upper wall portion of the air outlet.

3. The air conditioner according to claim 2, wherein on one end of the cover plate, a forked portion engaged with the first stopping piece is formed, and between the other end of the cover plate and the second stopping piece, engaging stopping means by convexo-concave engagement is provided.

4. The air conditioner according to claim 3, wherein at the second stopping piece, a handle portion is provided which releases the convexo-concave engagement of the engaging stopping means by elastically deforming said second stopping piece.

5. The air conditioner according to claim 1, wherein the supporting means includes a first stopping piece provided upward from an upstream position of the upper wall portion of the air outlet, and a second stopping piece suspended toward the inside of the air outlet from the down stream position of the upper wall portion of the air outlet, and wherein one end portion of the cover plate is lifted up along the first stopping piece so as to substantially construct part of the air outlet, and at a foremost end thereof, a step portion is provided which engages with end portion of said first stopping piece, while at the second stopping piece, holding means for the other end portion of cover plate is provided.

6. The air conditioner according to claim 1, wherein a driving lever is laid across and hooked onto each of the lateral louvers and each of the lateral louvers is rotated to and fro within a range of a specified angle by a driving motor by the driving lever, and wherein initial angle setting means which includes a number of grooves for setting an initial angle of the lateral louvers is formed on the driving lever and on either one of the top and bottom surfaces of the arm, a stopping projection engaged in an arbitrary groove in the initial angle setting means is provided, while on the other surface of the arm, connecting means for the connecting plate is provided.

7. The air conditioner according to claim 6, wherein the arm includes a stopper for regulating the rotation range of the lateral louvers by abutting against one of the driving lever and the connecting plate.

8. The air conditioner according to claim 6, wherein a first holding frame for holding the driving lever is formed on one surface of the arm so that the groove of the initial angle setting means is not disengaged from the stopping projection.

9. The air conditioner according to claim 6, wherein the connecting means for the connecting plate is defined by a connecting hole provided on said connecting plate and a connecting pin formed on the other surface of the arm, and wherein a second holding frame for elastically holding the connecting plate is provided on the other surface of the arm so that the connecting hole is not disengaged from the connecting pin.

10. An air conditioner including a housing in which an inlet port and an air outlet are formed, with a heat exchanger and an air fan being provided in an air passage from the air inlet port to the air outlet, which is provided with at least one longitudinal louver rotating in a vertical direction with an almost horizontal rotation axis line and a number of lateral louvers rotating in a lateral direction with a rotation axis line almost perpendicular to the rotation axis line of the longitudinal louvers, and with a driving lever which is laid across and hooked onto each of the lateral louvers and each of the lateral louvers being rotated to and fro within a range of a specified angle by a driving motor by said driving lever, wherein a link arm attached between an end proton of the driving lever and the driving motor is included, with a connection hole provided at the end portion of the driving lever and a tongue piece partially projecting from a circumferential edge of the end portion, and wherein a driving hole engaged with a driving shaft of the driving motor is formed at one end of the link arm, while a connection-pin engaged in the connecting hole of the driving lever and a housing notch which allows the tongue piece of the driving lever to enter are provided on the other end of said link arm, and the tongue piece is located in the housing notch, the tongue piece being placed in the housing notch when the link arm is rotated by the driving motor within a range of a specified angle around the driving hole.

11. The air conditioner according to claim 10, wherein the tongue piece is projected in a direction almost perpendicular to the longitudinal direction of the driving lever.

12. An air conditioner including a housing in which an inlet port and an air outlet are formed, with a heat exchanger and an air fan being provided in an air passage from the air inlet port to the air outlet, which is provided with at least one longitudinal louver rotating in a vertical direction with an almost horizontal rotation axis line and a number of lateral louvers rotating in a lateral direction with a rotation axis line almost perpendicular to the rotation axis line of the longitudinal louvers and each of the lateral louvers is rotated to and fro within a range of a specified angle by a driving motor, comprising:

a cover plate having a size to cover an upper wall portion of the air outlet and having a number of holes provided at positions corresponding to rotation supporting shafts of the lateral louvers;

supporting means supporting said cover plate with a specified interval maintained relative to the upper wall portion of the air outlet;

bushes attached in the hole of the cover plate so as to be free to rotate;

a first and a second driving levers assigned to each group of the lateral louvers divided at a center thereof;

connecting means connecting end portions of said driving levers opposing to each other and link means for connecting one of the driving levers to the driving motor, the bush being provided with a base end portion having a shaft hole engaged with a rotation supporting shaft of each of the lateral louvers and engaged in the hole of the cover plate so as to be free to rotate, and an arm extended along a top surface of the cover plate so as to be perpendicular to an axis line of the shaft hole from said base end portion and having connecting means for one of the first and second driving levers at a foremost end portion, each of the lateral louvers being held in the hole of the cover plate by the base end portion of the bush so as to be free to rotate, and the arm and the first and second driving levers being housed in a space between the cover plate and the upper wall portion of the air outlet.

13. The air conditioner according to claim 12, wherein the first and second driving levers are formed of band plates of a specified length and the connecting means includes a concave portion formed on a flat surface of an end portion of one of the driving levers and a convex portion formed on a flat surface of an end portion of the other driving lever.

14. The air conditioner according to claim 13, wherein a connecting piece in a U-shaped form receiving the end portion of the one of the driving levers with elastic deformation is formed at the end portion including the convex portion of the other driving lever.

15. The air conditioner according to claim 14, wherein at an inserting end of the one of the driving levers for the open portion of the connecting piece, a slanting surface is formed in order to be easily inserted into said open portion.

16. The air conditioner according to claim 15, wherein a flange abutted to the open portion of the connecting piece is formed at an end portion opposite to the inserting end of the one of the driving levers.

17. The air conditioner according to claim 1, wherein the bush has elasticity and is formed of synthetic resin containing lubricant.

* * * * *